US010464228B2

(12) United States Patent
Khubani et al.

(10) Patent No.: US 10,464,228 B2
(45) Date of Patent: Nov. 5, 2019

(54) LIGHTED SHAVING APPARATUS

(71) Applicants: Anand Khubani, Towaco, NJ (US); Eric Langberg, Milford, PA (US); Aaron Szymanski, Morristown Thomaston, CT (US)

(72) Inventors: Anand Khubani, Towaco, NJ (US); Eric Langberg, Milford, PA (US); Aaron Szymanski, Morristown Thomaston, CT (US)

(73) Assignee: IdeaVillage Products Corporation, Wayne, NJ (US)

( * ) Notice: Subject to any disclaimer, the term of this patent is extended or adjusted under 35 U.S.C. 154(b) by 0 days.

(21) Appl. No.: 15/932,884

(22) Filed: May 15, 2018

(65) Prior Publication Data

US 2018/0326605 A1 Nov. 15, 2018

Related U.S. Application Data

(60) Provisional application No. 62/506,417, filed on May 15, 2017.

(51) Int. Cl.

| | |
|---|---|
| ***F21V 21/00*** | (2006.01) |
| ***B26B 21/46*** | (2006.01) |
| ***B26B 21/40*** | (2006.01) |
| ***B26B 21/22*** | (2006.01) |
| ***B26B 21/52*** | (2006.01) |
| ***B26B 21/38*** | (2006.01) |
| ***A45D 27/00*** | (2006.01) |
| ***F21V 21/30*** | (2006.01) |
| ***F21V 23/00*** | (2015.01) |
| ***F21V 23/04*** | (2006.01) |

(52) U.S. Cl.

CPC ..... *B26B 21/46* (2013.01); *A45D 27/00* (2013.01); *B26B 21/225* (2013.01); *B26B 21/38* (2013.01); *B26B 21/405* (2013.01); *B26B 21/521* (2013.01); *B26B 21/522* (2013.01); *F21V 21/30* (2013.01); *F21V 23/001* (2013.01); *F21V 23/008* (2013.01); *F21V 23/0414* (2013.01)

(58) Field of Classification Search

CPC ..... B26B 21/46; B26B 21/38; B26B 21/405; B26B 21/521; B26B 21/522; A45D 27/00; F21V 21/30; F21V 23/001; F21V 23/008

USPC ..... 362/115

See application file for complete search history.

(56) References Cited

U.S. PATENT DOCUMENTS

| | | | | | |
|---|---|---|---|---|---|
| 1,180,686 | A * | 4/1916 | Allport | H01M 2/1055 | 15/324 |
| 1,862,274 | A * | 6/1932 | Mendelsohn | B26B 21/46 | 30/34.05 |
| 1,900,965 | A * | 3/1933 | Weiss | B26B 21/46 | 30/34.05 |
| 4,094,062 | A * | 6/1978 | Papanikolaou | B26B 21/46 | 30/34.05 |
| 4,473,943 | A * | 10/1984 | Papanikolaou | B26B 21/46 | 30/34.05 |
| 5,582,476 | A * | 12/1996 | Hansen | B26B 21/46 | 362/115 |

(Continued)

*Primary Examiner* — Laura K Tso

(74) *Attorney, Agent, or Firm* — Dan DeLaRosa

(57) ABSTRACT

The present invention provides for a lighted shaving apparatus and more specifically, to a shaving apparatus with a pivotally attached lighting device and a blade cartridge with at least two blades and the light illuminates through a space between the two blades and forms a shaving guide.

27 Claims, 4 Drawing Sheets

(56) References Cited

U.S. PATENT DOCUMENTS

| | | | | |
|---|---|---|---|---|
| 6,227,676 | B1 * | 5/2001 | Sneddon | B26B 21/46 250/459.1 |
| 6,915,576 | B2 * | 7/2005 | Brzezinski | B26B 21/46 30/123 |
| 8,065,802 | B2 * | 11/2011 | Oglesby | B26B 21/46 30/32 |
| 8,089,227 | B2 * | 1/2012 | Baertschi | A46B 15/0075 318/119 |
| 9,168,662 | B1 * | 10/2015 | Brown | B26B 21/46 |
| 9,592,615 | B1 * | 3/2017 | Broeske | B26B 21/46 |
| 2007/0107229 | A1 * | 5/2007 | Ribal | B26B 19/46 30/34.05 |
| 2008/0028616 | A1 * | 2/2008 | Kwak | B26B 21/46 30/32 |
| 2008/0134511 | A1 * | 6/2008 | Salvatore | B26B 21/46 30/32 |
| 2008/0250645 | A1 * | 10/2008 | Tringali | B26B 19/06 30/34.05 |
| 2012/0268923 | A1 * | 10/2012 | Lin | B26B 19/382 362/183 |
| 2016/0143410 | A1 * | 5/2016 | Stampe | B26B 19/46 606/133 |

* cited by examiner

LIGHTED SHAVING APPARATUS

RELATED APPLICATION

This application is based on the provisional patent application entitled "LIGHTED SHAVING APPARATUS" with U.S. Ser. No. 62/506,417 filed on May 15, 2017.

BACKGROUND OF THE INVENTION

Field of the Invention

This invention relates to a lighted shaving apparatus and more specifically, to a shaving apparatus with a pivotally attached lighting device and a blade cartridge with at least two blades and the light illuminates through a space between the two blades and forms a shaving guide.

SUMMARY OF THE INVENTION

In one embodiment, the present invention relates to a lighted shaving apparatus comprising: a housing having opposing ends, a first bottom end forming a handle and a second top end having a connecting member; a lighting device pivotally attached to the connecting member, and the lighting device having a front and back side, the front side comprises at least one light; and at least one blade cartridge having at least two blades and space between the blades, the blade cartridge is designed to be attachable to and detachable from the top side of the housing, and when in a use position, the lights are activated and illuminates through the space between the blades to thereby illuminate a user's face when shaving.

In another embodiment, the housing comprises an internal cavity and an exterior surface. In still another embodiment, the apparatus further comprises a power source, and the power source is situated within the cavity of the housing. In yet another embodiment, the power source is selected from a group consisting essentially of batteries, rechargeable batteries, cells and combinations thereof.

In still yet another embodiment, the light moves pivotally with a movement of the blade cartridge. In a further embodiment, the apparatus further comprises a first button for slidably moving the connecting member thereby moving said lighting device. In another further embodiment, the apparatus further comprises a second button for detaching the attached blade cartridge. In still a further embodiment, the first and second buttons are the same button, and the same button moves in one direction to move the connecting member and in an opposite direction to detach the attached blade cartridge, and the same button is situated on an external surface of the housing.

In yet a further embodiment, the apparatus further comprises a light button for activating the light, and the button is situated on an external surface of the housing. In still yet a further embodiment, the apparatus further comprises an agitator, and the agitator is designed to create vibration.

In another embodiment, the light creates a visible line on a surface to be shaved, and the visible line acts as a guide for shaving.

In still another embodiment, the top portion of said housing further comprises at least two pins and the blade cartridge further comprises at least two apertures for receiving the pins and securing the blade cartridge to the housing. In yet another embodiment, the blade cartridge is pivotally attached to the pins of the housing during the use position.

In still yet another embodiment, the top portion of the housing is angled to provide for optimal shaving. In a further embodiment, a portion of the housing comprises grips.

In another further embodiment, the present invention provides for a lighted shaving apparatus comprising: a housing having opposing ends, a first bottom end forming a handle and a second top end having a connecting member, and the top end of the housing has at least one pin; and a lighting device pivotally attached to the connecting member, the lighting device has a front and back side, the front side comprising at least one light, and the pin is designed to hold at least one blade cartridge.

In yet another embodiment, the apparatus further comprises at least one blade cartridge having at least two blades, space between the blades and at least one aperture for receiving the pin, the blade cartridge designed to be attachable to and detachable from the pin, when in a use position, the lights are activated and illuminates through the space between the blades to thereby illuminate a user's face when shaving.

In a further embodiment, the top end of the housing has at least two pins and the blade cartridge has a back side with at least two apertures for receiving the pins, and the blade cartridge is pivotally attached to the two pins on the top end of the housing.

In another further embodiment, the present invention relates to a lighted shaving apparatus comprising: a housing having opposing ends, a first bottom end forming a handle and a second top end having a connecting member; a lighting device pivotally attached to the connecting member, and the lighting device has a front and back side, the front side comprises at least one light; and at least one blade cartridge has at least two blades and space between the blades, the blade cartridge is designed to be attachable to and detachable from the lighting device, when in a use position, and the lights are activated and illuminates through the space between the blades to thereby illuminate a user's face when shaving.

In yet another further embodiment, the apparatus further comprises at least one button that moves in one direction to move the connecting member and in an opposite direction to detach the attached blade cartridge.

In another embodiment, the present invention relates to a lighted shaving apparatus comprising: a housing having a first bottom end forming a handle and an opposing second top end having a connecting member configured to secure a blade cartridge; and a lighting device configured to illuminate a user's face when shaving.

In a further embodiment, the apparatus further comprises a vibration device and the blade cartridge further comprises a blade and the light projects a line on the user's face.

In another further embodiment, the apparatus further comprises at least one button that moves in one direction to move the connecting member and in an opposite direction to detach the attached blade cartridge.

In yet another further embodiment, the present invention relates to a lighted shaving apparatus for holding a blade cartridge comprising: a housing having a first bottom end forming a handle and an opposing second top end having a lighting device and a connecting member configured to secure the blade cartridge, wherein the lighting device is configured to shine between two blades of the blade cartridge.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
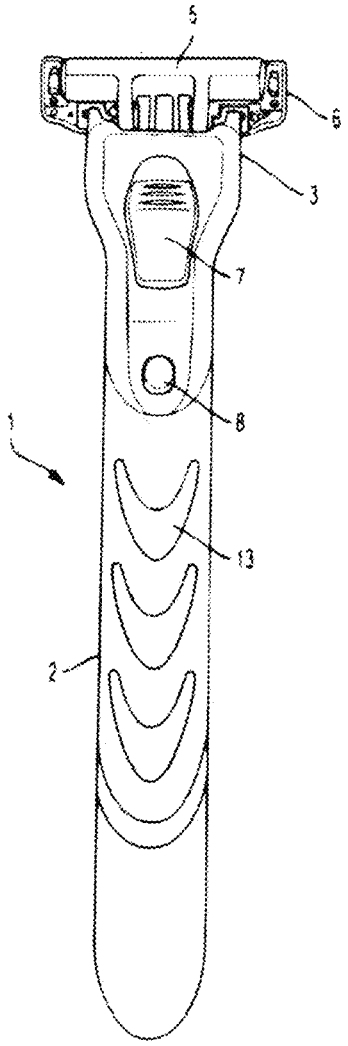
FIG. 1 is a perspective view of one of the embodiments of the present invention.

FIG. 1 illustrates a top perspective view of the shaving apparatus showing the housing 1 with a first end (handle) 2 and a top end 3 with a lighting device 5 and blade cartridge 6, a button 7, light button 8, and grips 13. The lighting device 5 is connected to the top end 3 of the shaving apparatus. The lighting device 5 can be connected using multiple methods. The methods of connection for the lighting device 5 can be chosen from a pivot mechanism, hinge, joint, or other connection that allows for movement. A movable lighting device 5, allows the user to access the blade cartridge 6 for cleaning, installing, and/or removing. The button 7 allows a user to move the lighting device 5 into a desired position or orientation depending on if it is being moved for cleaning, removing, or installing the blade cartridge 6. A movable lighting device allows the lighting device 5 to move with the blade cartridge as it pivots while contacting a user's body. The ability for the lighting device 5 and the blade cartridge 6 to move together also helps to ensure that the light from the lighting device 5 is always in the right orientation so that it produces the desire effect of projecting a line of light on the user's body.

The button 8 controls both the lighting device 5 and the surface light 9. The button allows the user to turn on and off both the lighting device 5 and the surface light 9. The button 8 also controls the vibration mode for the shaving apparatus.

Figure 2:
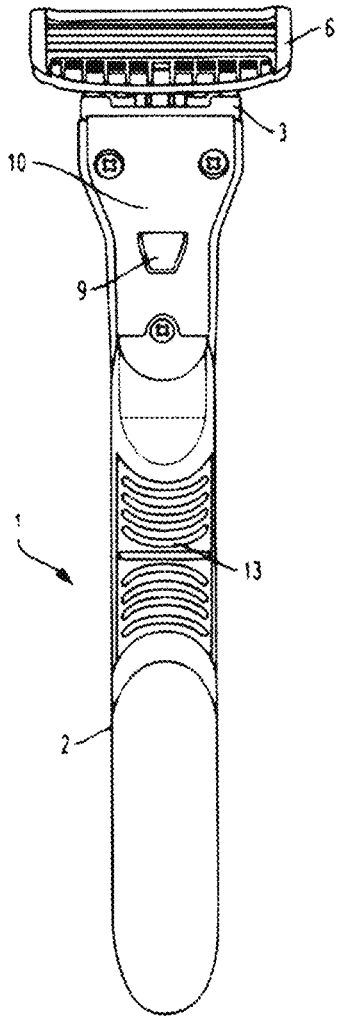
FIG. 2 is a perspective view of one of the embodiments of the present invention.

FIG. 2 illustrates a bottom perspective view of the shaving apparatus showing the housing 1 with a first end (handle) 2 and a top end 3 with a blade cartridge 6, and grips 13. The figure further shows surface light 9 and cavity 10. The cavity 10 contains wiring, control circuitry (not shown), and a surface light 9. The control circuitry allows the user to turn on and off the lighting device 5, surface light 9, and the vibration mechanism via button 8. The cavity 10 can also hold a power supply, such a s a battery. The grips 13 can be made of various materials such as plastic, rubber, silicon, metal, or combinations thereof. The grips 13 can also be in any shape or pattern that will assist the user in securely handling the shaving apparatus. The first end 2 of the shaving apparatus is hollow and capable of receiving a power source such as a battery.

Figure 3:
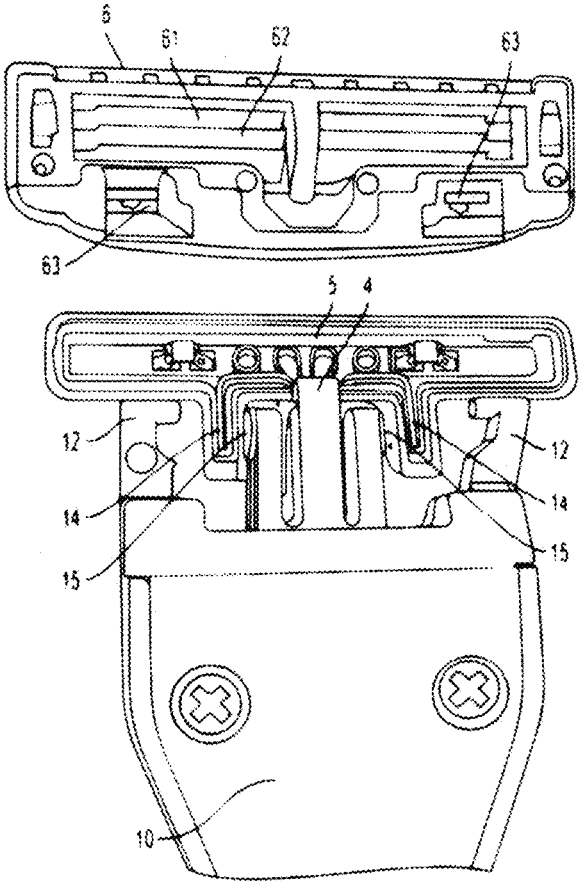
FIG. 3 is a perspective view of one of the embodiments of the present invention.

FIG. 3 illustrates the cavity 10 of the housing. The cavity contains an agitator and power source for the shaving apparatus (not shown). The figure illustrates the blade cartridge 6 having blades 61 and space between the blades 62, and apertures 63. The figure further shows pins 12 that are received by the apertures 63 to connect the blade cartridge to the top end 3 of the housing 1. The figure also illustrates the lighting device 5 which is pivotally connected to the housing 1 at the top end 3 by the connecting member 4 that has a pivot point 15. The lighting device 5 is powered by wires 14 that run from the power source (not shown) in the cavity 10 through the pivot point 15 to the lighting device 5. Having the wires 14 run through the pivot point 15 allows the lighting device 5 to maintain its connection to the power source while it moves during use. This configuration maintains the maximum amount of movement and flexibility for lighting device 5 while in use. The light created by the lighting device 5 is designed to project through the blade cartridge and create a line of light that acts as a shaving guide for the user.

Figure 4:
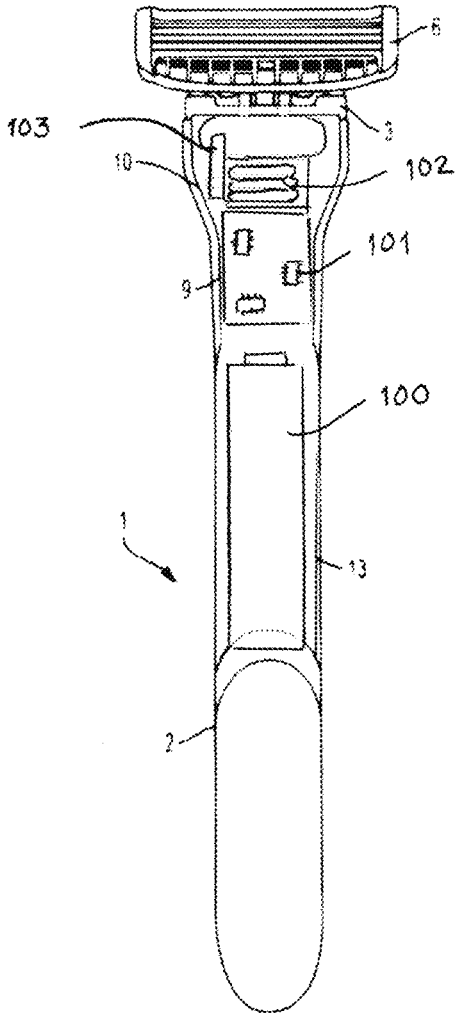
FIG. 4 is an internal view of the housing of the apparatus of the present invention.

FIG. 4 shows the internals of the housing 1 which includes the power source 100 which is battery (and can be rechargeable battery), the control circuitry 101, the motor 102 and the agitator 103.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A lighted shaving apparatus comprising:

a housing having opposing ends, a first bottom end forming a handle and a second top end having a connecting member;

a lighting device pivotally attached to said connecting member, said lighting device having a front and back side, said front side comprising at least one light; and at least one blade cartridge having at least two blades and space between said blades, said blade cartridge designed to be attachable to and detachable from said top side of said housing, when in a use position, said lights are activated and illuminates through said space between said blades to thereby illuminate a user's face when shaving.

2. The apparatus of claim 1 wherein said housing comprises an internal cavity and an exterior surface.

3. The apparatus of claim 2 further comprising a power source, said power source is situated within said cavity of said housing.

4. The apparatus of claim 1 wherein said first bottom end forming a handle is hollow and contains a power source.

5. The apparatus of claim 3 wherein said power source is selected from a group consisting essentially of batteries, rechargeable batteries, and combinations thereof.

6. The apparatus of claim 1 wherein said light moves pivotally with movement of said blade cartridge.

7. The apparatus of claim 5 wherein said light is attached at a pivot point.

8. The apparatus of claim 6 where at least one wire runs through said pivot point from said cavity to said light to provide power.

9. The apparatus of claim 2 further comprises a first button for slidably moving said connecting member thereby moving said lighting device.

10. The apparatus of claim 9 further comprises a second button for detaching said attached blade cartridge.

11. The apparatus of claim 1 said internal cavity contains control circuitry.

12. The apparatus of claim 1 said internal cavity contains wires.

13. The apparatus of claim 1 said internal cavity contains a motor, said motor creates vibration.

14. The apparatus of claim 10 wherein said first and second buttons are the same button, said same button moves in one direction to move said connecting member and in an opposite direction to detach said attached blade cartridge, said same button is situated on said external surface of said housing.

15. The apparatus of claim 1 further comprises a light button for activating said light, said button being situated on said external surface of said housing.

16. The apparatus of claim 1 further comprises an agitator, said agitator designed to create vibration.

17. The apparatus of claim 1 wherein said light button activates said agitator.

18. The apparatus of claim 1 having a surface light.

19. The apparatus of claim 1 wherein said light button activate said surface light.

20. The apparatus of claim 1 wherein said light creates a visible line on a surface to be shaved, said visible line acts as a guide for shaving.

21. The apparatus of claim 1 wherein said top portion of said housing further comprises at least two pins and said blade cartridge further comprises at least two apertures for receiving said pins and securing said blade cartridge to said housing.

22. The apparatus of claim 21 wherein said blade cartridge is pivotally attached to said pins of said housing during said use position.

23. The apparatus of claim 1 wherein said top portion of said housing is angled to provide for optimal shaving.

24. The apparatus of claim 1 wherein a portion of said housing comprises grips.

25. A lighted shaving apparatus comprising:

a housing having opposing ends, a first bottom end forming a handle and a second top end having a connecting member, said top end of said housing having at least one pin; and a lighting device pivotally attached to said connecting member, said lighting device having a front and back side, said front side comprising at least one light, said pin designed to hold at least one blade cartridge.

26. The apparatus of claim 25 further comprises at least one blade cartridge having at least two blades, space between said blades and at least one aperture for receiving said pin, said blade cartridge designed to be attachable to and detachable from said pin, when in a use position, said lights are activated and illuminates through said space between said blades to thereby illuminate a user's face when shaving.

27. The apparatus of claim 25 wherein said top end of said housing has at least two pins and said blade cartridge has a back side with at least two apertures for receiving said pins, said blade cartridge is pivotally attached to said two pins on said top end of said housing.

* * * * *